US006648580B2

(12) United States Patent
Lofgren

(10) Patent No.: US 6,648,580 B2
(45) Date of Patent: Nov. 18, 2003

(54) ROLL-HANDLING ATTACHMENT FOR LIFTER

(75) Inventor: Gunnar Lofgren, Charlotte, NC (US)

(73) Assignee: R ON I, LLC, Charlotte, NC (US)

( * ) Notice: Subject to any disclaimer, the term of this patent is extended or adjusted under 35 U.S.C. 154(b) by 98 days.

(21) Appl. No.: 10/016,351

(22) Filed: Nov. 2, 2001

(65) Prior Publication Data

US 2002/0054811 A1 May 9, 2002

Related U.S. Application Data

(60) Provisional application No. 60/245,761, filed on Nov. 3, 2000.

(51) Int. Cl.[7] ..... B66C 1/54

(52) U.S. Cl. ..... 414/607; 414/619; 414/663

(58) Field of Search ..... 414/598, 607, 414/619, 620, 628, 745.8, 910, 908, 738, 724

(56) References Cited

U.S. PATENT DOCUMENTS

| | | | | | |
|---|---|---|---|---|---|
| 1,668,990 | A | * | 5/1928 | Tromblay | 242/573.2 |
| 3,079,102 | A | * | 2/1963 | Douglas | 242/573 |
| 3,734,328 | A | * | 5/1973 | Dalglish | 414/620 |
| 4,032,185 | A | * | 6/1977 | Peyton | 294/97 |
| 4,166,647 | A | * | 9/1979 | Schmidt | 294/86.41 |
| 4,358,143 | A | * | 11/1982 | Cullen | 294/64.1 |
| 4,430,040 | A | * | 2/1984 | Halmos | 414/783 |
| 4,557,515 | A | * | 12/1985 | Read | 294/67.22 |
| 4,708,574 | A | * | 11/1987 | Conboy et al. | 414/591 |
| 4,832,281 | A | | 5/1989 | Payne, Jr. et al. | |
| 5,165,620 | A | * | 11/1992 | Kampiziones | 242/573.2 |
| 5,468,116 | A | * | 11/1995 | Reichert et al. | 414/607 |
| 6,119,974 | A | | 9/2000 | Wente et al. | |

FOREIGN PATENT DOCUMENTS

| | | | | |
|---|---|---|---|---|
| FR | 2556330 | A1 * | 6/1985 | B66F/9/18 |

* cited by examiner

*Primary Examiner*—Dean J. Kramer
*Assistant Examiner*—Charles A. Fox
(74) *Attorney, Agent, or Firm*—Adams Evans, P.A.

(57) ABSTRACT

An apparatus for moving a roll of material having a cylindrical bore from a vertical position on a surface to a horizontal position at a height above the surface includes a support mandrel for positioning in the bore in advance of moving the roll. An expansion assembly cooperates with the support mandrel for varying a lateral dimension of the support mandrel between a bore insertion dimension at which the support mandrel is inserted into and withdrawn from the bore, and a bore engaging dimension at which the support mandrel engages the walls of the roll defining the bore and locks the support mandrel and the roll together against relative movement. A swivel assembly to which the support mandrel is connected, rotates the support mandrel from the vertical position to the horizontal position. The swivel assembly is vertically moveable along a stanchion, enabling positioning of the roll at a desired height.

20 Claims, 13 Drawing Sheets

10
22
24

14
x
40
39
41
41
15
23
26
21
25
27
13
12
11

ROLL-HANDLING ATTACHMENT FOR LIFTER

This patent application claims priority to U.S. Provisional Patent Application No. 60/245,761 filed on Nov. 3, 2000. The invention relates to an apparatus for moving an object having a bore therein, particularly rolls of paper, film or fiber. It is common for such materials as paper and various films and fibers to be manufactured and stored in the form of large, heavy rolls that have a three to six inch cylindrical bore at its center. Such a bore is commonly referred to as a "roll core." Typically, it is necessary to move such rolls of material from a point of manufacture to an appropriate place for storage or to a vehicle for transport to another destination. In addition, such material rolls are used in a wide variety of industrial applications, and, as such, the need for efficiently moving the rolls in an industrial setting is wide spread. Furthermore, it is quite common in such industrial settings for it to be necessary to move the material rolls from a vertical position on a work surface to a horizontal position at a predetermined height above the work surface for storage or transport.

TECHNICAL FIELD AND BACKGROUND OF THE INVENTION

It is inefficient and unsafe for personnel to move such material rolls by hand as they typically weigh more than one hundred pounds, and the average person quickly gets fatigued after lifting and moving several rolls. As a person gets more fatigued the risk of sustaining an injury to himself or fellow co-workers increases, while efficiency decreases. Machinery for moving the material rolls can be complex and costly. In an effort to overcome and eliminate the aforementioned problems, the present invention was conceived.

SUMMARY OF THE INVENTION

Therefore it is an object of the present invention to provide an apparatus for efficiently and ergonomically moving a roll of paper, film or fiber having a roll core from a vertical position on a surface to a horizontal position at a predetermined height.

It is another object of the invention to provide a roll handling apparatus that can be easily adjusted to fit various rolls without disrupting production or requiring an additional lifter.

It is yet another object of the invention to provide a roll handling apparatus that is safe and easy to operate, can be operated manually or electrically, and will not damage the roll core or surface.

These and other objectives of the present invention are achieved by providing an apparatus for moving an object having a bore therein defined by walls of the object from a first position to a second position. The apparatus includes a support mandrel for being positioned in the bore at the first position in advance of moving the object. An expansion assembly cooperates with the support mandrel for varying a lateral dimension of the support mandrel while positioned in the bore between a bore insertion dimension at which the support mandrel may be inserted into and withdrawn from the bore, and a bore engaging dimension at which the support mandrel engages the walls of the object defining the bore and locks the support mandrel and the object together against relative movement. A swivel assembly to which the support mandrel is connected, enables movement of the support mandrel from the first position to the second position. The object carried by the support mandrel is moved in unison with the movement of the support mandrel and is released by the support mandrel at the second position.

According to one preferred embodiment of the invention, first and second positions of the support mandrel define an angle of approximately ninety degrees.

According to another preferred embodiment of the invention, the swivel assembly moves the support mandrel from a vertical position to a horizontal position.

According to yet another preferred embodiment of the invention, the object is a roll of material having a cylindrical bore defined by inner walls of the roll.

According to yet another preferred embodiment of the invention, the swivel assembly includes a plate for mounting the support mandrel, and a handle connected to the swivel plate and in communication with the support mandrel whereby turning the handle moves the support mandrel from the first position to the second position.

According to yet another preferred embodiment of the invention, the support mandrel is releasably locked at a desired position on the swivel plate and can be moved to varying positions on said plate to accommodate objects of varying size.

According to yet another preferred embodiment of the invention, the support mandrel is positioned on the plate such that the object and the support mandrel counter-balance the swivel assembly to facilitate turning of the handle.

According to yet another preferred embodiment of the invention, the apparatus includes an electric motor in communication with the expansion assembly for varying the lateral dimension of the support mandrel between the insertion dimension and the engaging dimension.

According to yet another preferred embodiment of the invention, the apparatus includes a stanchion for mounting the swivel assembly, and the swivel assembly is vertically moveable along the stanchion for lowering the support mandrel into a bore defined by walls of an object positioned vertically on a surface and raising the object to a desired height above the surface.

According to yet another preferred embodiment of the invention, the apparatus includes an electric motor in communication with the swivel assembly for moving the swivel assembly vertically along the stanchion.

According to yet another preferred embodiment of the invention, the support mandrel is a hollow cylinder having an interior and exterior.

According to yet another preferred embodiment of the invention, the support mandrel includes two semi-cylindrical plates connected to a pivot rod, and the expansion assembly varies the lateral dimension of the support mandrel from the bore insertion dimension to the bore engaging dimension by urging the semi-cylindrical plates to pivotally move outward to frictionally engage the walls defining the bore.

According to yet another preferred embodiment of the invention, the expansion assembly includes a center divider having a top and a base and extending longitudinally through the interior of the support mandrel.

According to yet another preferred embodiment of the invention, the base of the center divider is attached to the pivot rod.

According to yet another preferred embodiment of the invention, the expansion assembly includes a first roller longitudinally positioned in the top of the center divider for facilitating insertion of the support mandrel into the bore and withdrawal therefrom.

According to yet another preferred embodiment of the invention, a guiding member having an inclined surface is positioned longitudinally within the interior of the support mandrel and attached to one of the semi-cylindrical plates.

According to yet another preferred embodiment of the invention, the expansion assembly includes a sliding member contained within the center divider for longitudinally moving within the support mandrel. A second roller is attached to the sliding member, and is positioned within the support mandrel in axial alignment with the guiding member so that the second roller contacts the guiding member and urges the semi-cylindrical plate to pivotally move outward as the sliding member moves in the direction of increasing inclination of the guiding member. This causes the semi-cylindrical plate to contact and frictionally engage the walls defining the bore.

According to yet another preferred embodiment of the invention, a cam is mounted to the exterior of the support mandrel and connected to the sliding member so that the sliding member is responsive to movement of the cam.

An embodiment of the method for moving an object having a bore therein according to the invention includes the steps of providing a roll handling apparatus having a support mandrel for being positioned in the bore in a vertical position in advance of moving the object. An expansion assembly cooperates with the support mandrel for varying a lateral dimension of the support mandrel while positioned in the bore between a bore insertion dimension at which the support mandrel may be inserted into and withdrawn from the bore, and a bore engaging dimension at which the support mandrel engages the walls of the object defining the bore and locks the support mandrel and the object together against relative movement. A swivel assembly is connected to the support mandrel for movement from the vertical position to the horizontal position. The swivel assembly is mounted to a stanchion and is vertically moveable along the stanchion. The support mandrel is inserted into the bore defined by the object vertically positioned on a surface. After insertion, the support mandrel engages the object by expanding the lateral dimension of the support mandrel from the bore insertion dimension to the bore engaging dimension. The object is lifted off of the surface to a predetermined height by moving the swivel assembly upward along said stanchion. Finally, the object is moved from a vertical position to a horizontal position by moving the support mandrel from the vertical position to the horizontal position.

Another embodiment of the method for moving an object having a bore therein according to the invention includes the step of axially aligning the support mandrel with a receiving rod.

Yet another embodiment of the method for moving an object having a bore therein according to the invention includes the steps of disengaging the object by reducing the lateral dimension of the support mandrel from the bore engaging dimension back to the bore insertion dimension, and sliding the object off of the support mandrel and onto the receiving rod.

Yet another embodiment of the method for moving an object having a bore therein according to the invention includes the steps of providing a roll handling apparatus having a support mandrel including two semi-cylindrical plates connected to a pivot rod. Guiding members having an inclined surface are positioned longitudinally within the interior of the support mandrel and are attached to the semi-cylindrical plates. An expansion assembly includes a center divider having a top and a base, and is positioned within the support mandrel, extending longitudinally therethrough. A first plurality of rollers is longitudinally positioned in the top of the center divider for facilitating insertion of the support mandrel into the bore defined by the object and removal therefrom. A sliding member having a second roller is contained within the center divider. The second plurality of rollers is positioned in axial alignment with the guiding members such that the second plurality of rollers contacts the guiding members and urges the semi-cylindrical plates to pivotally move outward when the sliding member is moved in a direction of increased inclination of the guiding members. The support mandrel is mounted to a swivel assembly for moving the support mandrel about an angle of rotation of approximately ninety degrees. The swivel assembly is mounted to a stanchion and is vertically moveable along said stanchion. The support mandrel is inserted into the bore defined by the object positioned vertically on a surface. The support mandrel engages the object with the support mandrel by moving the sliding member in a direction of increased inclination of the guiding members to urge the semi-cylindrical plates to pivotally move outward and frictionally engage the walls of the object. The object is lifted off of the surface up to a predetermined height by moving the swivel assembly upward along the stanchion. The object is moved from a vertical position to a horizontal position by moving the swivel assembly to rotate the support mandrel about the angle of rotation.

Yet another embodiment of the method for moving an object having a bore therein according to the invention includes the step of disengaging the support mandrel from the object by moving the sliding member in a direction of declination of the guiding members so that the semi-cylindrical plates pivotally move inward and away from the walls of the object so that the object rests on the first plurality of rollers.

Yet another embodiment of the method for moving an object having a bore therein according to the invention includes the step of sliding the object on the first plurality of rollers off of the support mandrel and onto the receiving rod.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
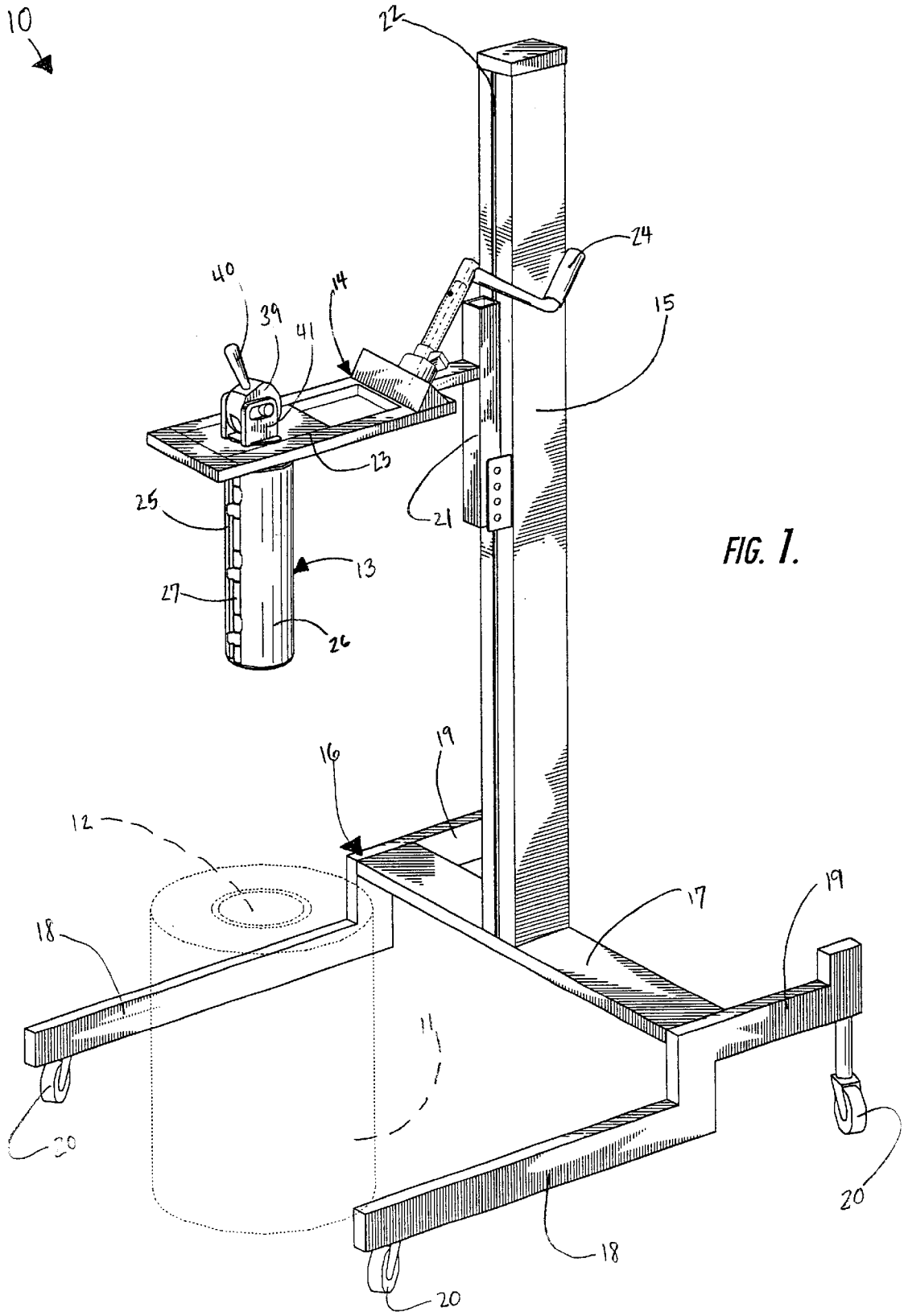
FIG. 1 is an environmental perspective view of the roll handling apparatus according to one embodiment of the invention.

Referring now specifically to the drawings, a preferred embodiment of the roll handling apparatus according to the present invention is illustrated in FIG. 1, and shown generally at reference numeral 10. FIG. 1 shows the roll handling apparatus 10 positioned over a roll of material 11, such as a roll of newsprint or other stock, having a hollow cylindrical core 12. The roll handling apparatus 10 is preferably made of metal and comprises a support mandrel 13 connected to a swivel assembly 14 mounted on a stanchion 15. The roll handling apparatus 10 is preferably for moving rolls of paper, film or fabric weighing up to 175 pounds and having inner cores of 3 to 6 inches in diameter. The roll handling apparatus 10 is preferably zinc plated.

As shown in FIG. 1, the roll handling apparatus 10 includes a stand 16 having a base leg 17, two forward legs 18 and two rear legs 19. Preferably, the forward legs 18 are approximately twice as long as the rear legs 19. The forward legs 18 and rear legs 19 each have a wheel 20 to facilitate movement of the roll handling apparatus 10 on a work surface. Preferably, at least one of the wheels 20 has a braking mechanism, not shown. The stanchion 15 is mounted perpendicularly at the center of base leg 17.

The stanchion 15 extends vertically upward from stand 16. A mounting bracket 21 is attached to the stanchion 15 and is moveable along a longitudinal cavity 22 defined by the stanchion 15. The swivel assembly 14 is mounted on the mounting bracket 21. The mounting bracket 21 can be releasably locked into position at a certain height on the stanchion 15 to allow positioning of the swivel assembly 14 at various heights on the stanchion 15. This enables the support mandrel 13 to be lowered into the roll core 12 and carry the roll 11 up to a certain height once the roll 11 has been engaged by the support mandrel 13.

Figure 2:
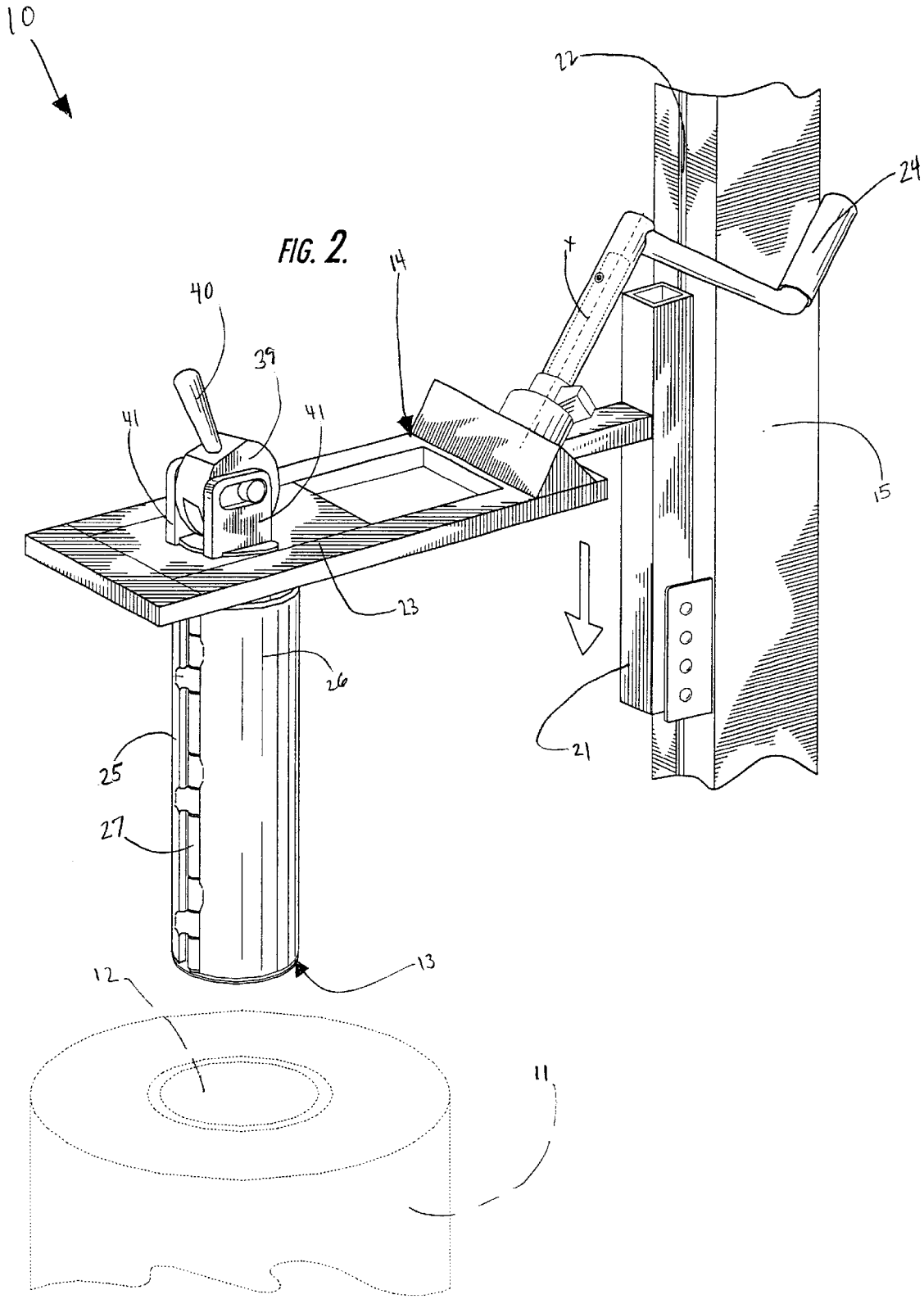
FIG. 2 is an enlarged partial perspective view of the roll handling apparatus shown in FIG. 1, with the support mandrel being lowered into a roll core.
Figure 6:
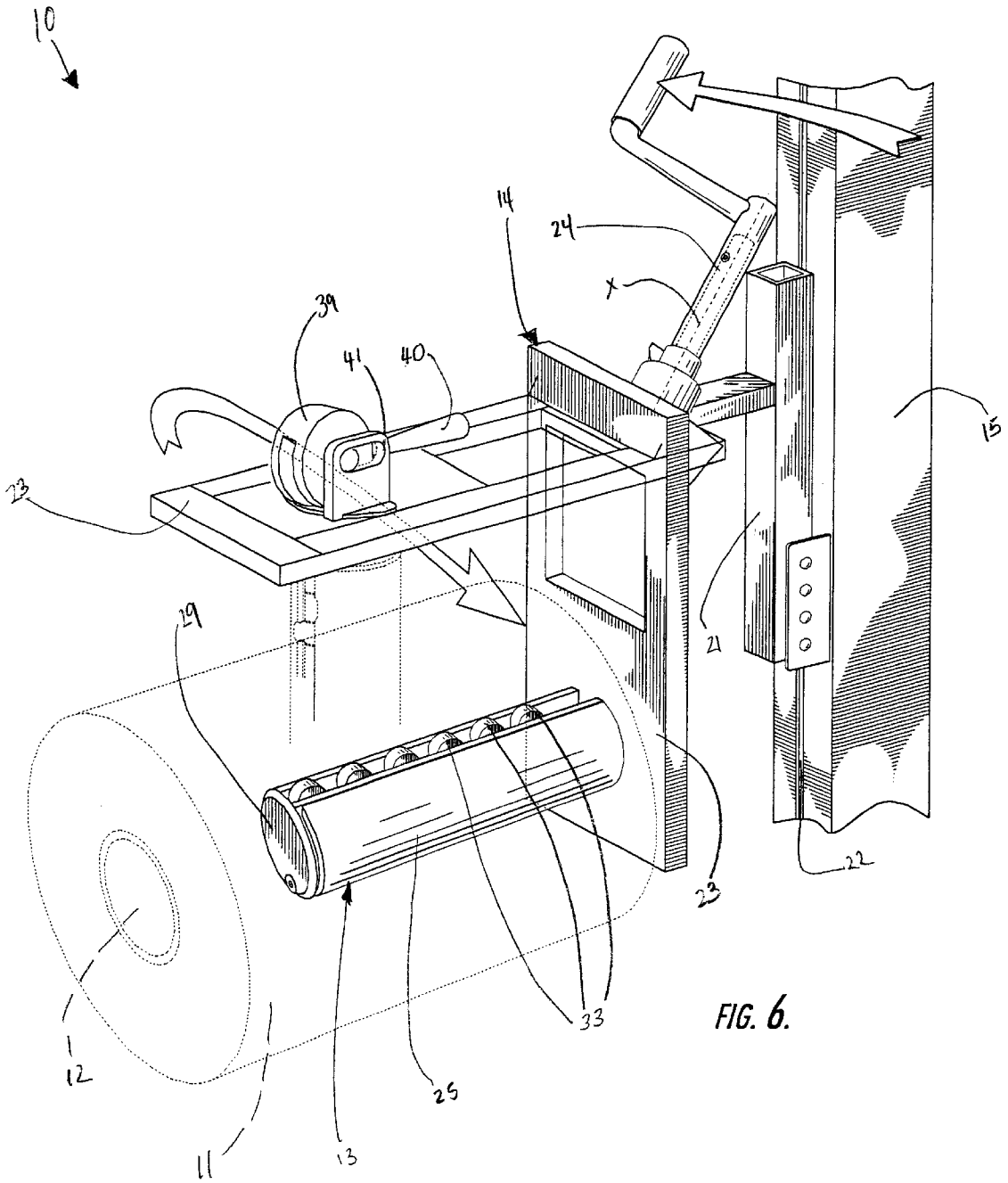
FIG. 6 shows the roll handling apparatus with the support mandrel rotated to a horizontal position.

As shown in FIGS. 1 and 2, the swivel assembly 14 comprises a swivel plate 23 and a handle 24. The swivel plate 23 and the handle 24 communicate with each other so that turning the handle 24 in a clockwise direction will move the swivel plate 23 from a horizontal position to a vertical position, as shown in FIG. 6. Turning the handle 24 in the counter-clockwise direction will move the swivel plate 23 from the vertical position back to the horizontal position.

Figure 3:
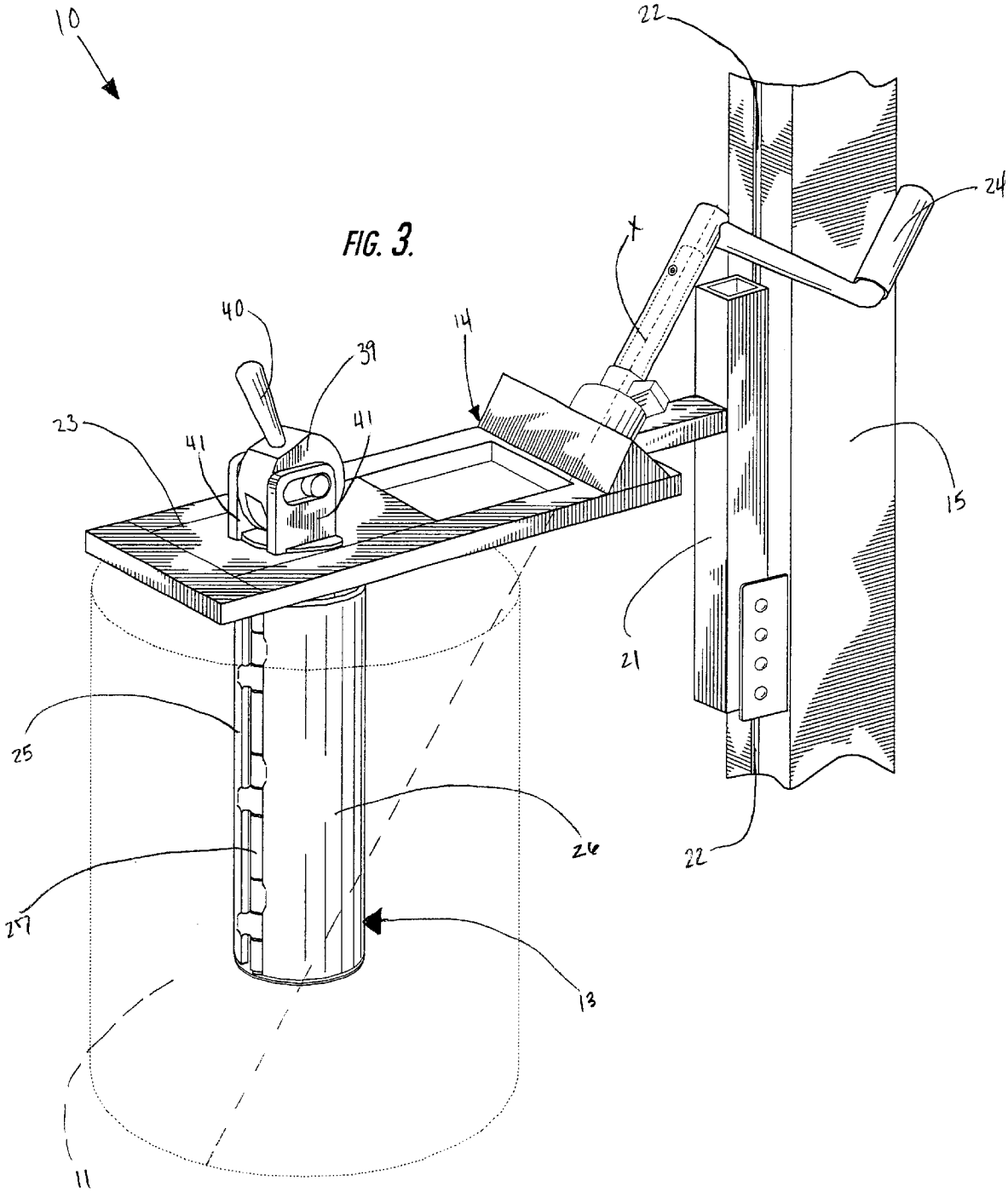
FIG. 3 shows the roll handling apparatus with the support mandrel inserted into the roll core.

The support mandrel 13 is mounted perpendicularly to the swivel plate 23 so that turning of the swivel handle 24 in a clock-wise direction moves the support mandrel 13 from a vertical position to a horizontal position, as shown in FIG. 6. The swivel handle 24 is positioned at a 45 degree angle. The support mandrel 13 is positioned on the swivel plate 23 so that a line x drawn through the center of the swivel handle 24 diagonally bisects the center of roll 11, as shown in FIG. 3. In this position, the roll 11, support mandrel 13 and swivel assembly 14 are balanced on all sides. The counterbalancing weights enable the user to turn the swivel handle 24 with minimal effort. As can best be seen in FIGS. 9 and 10, the support mandrel 13 comprises two semi-cylindrical plates 25, 26 connected to a pivot rod 27 at the base of the support mandrel 13, and first and second lateral end plates 28, 29.

The roll handling apparatus 10 also includes an expansion assembly 30 that enables the support mandrel 13 to vary from a first dimension that can be inserted into and removed from a roll core 12, to a second larger dimension that frictionally engages the interior surface of the roll 11. The roll 11 and the support mandrel 13 are locked together against relative movement so that the roll 11 can be moved in unison with the support mandrel 13.

Figure 9:
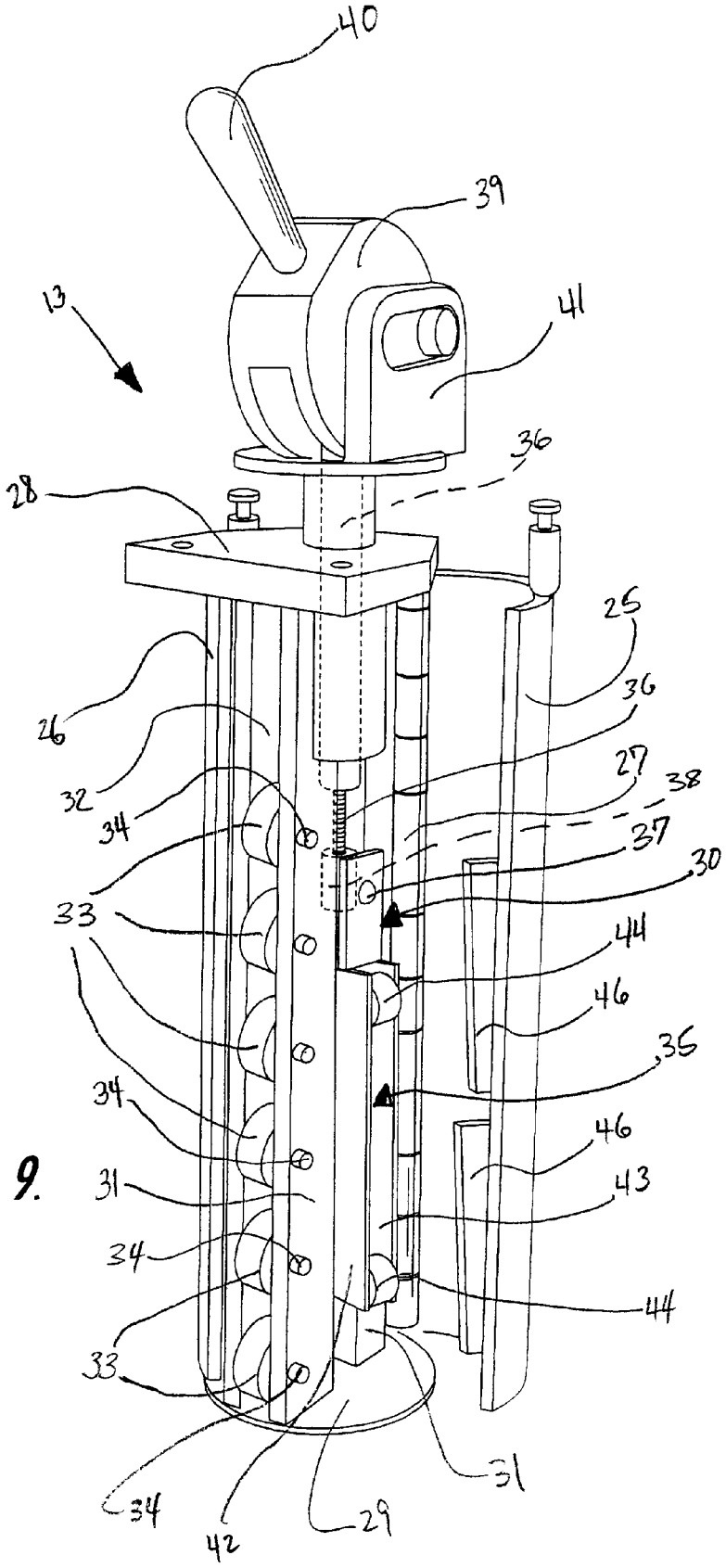
FIG. 9 is a perspective view of the support mandrel and expansion assembly according to one embodiment of the invention.
Figure 10:
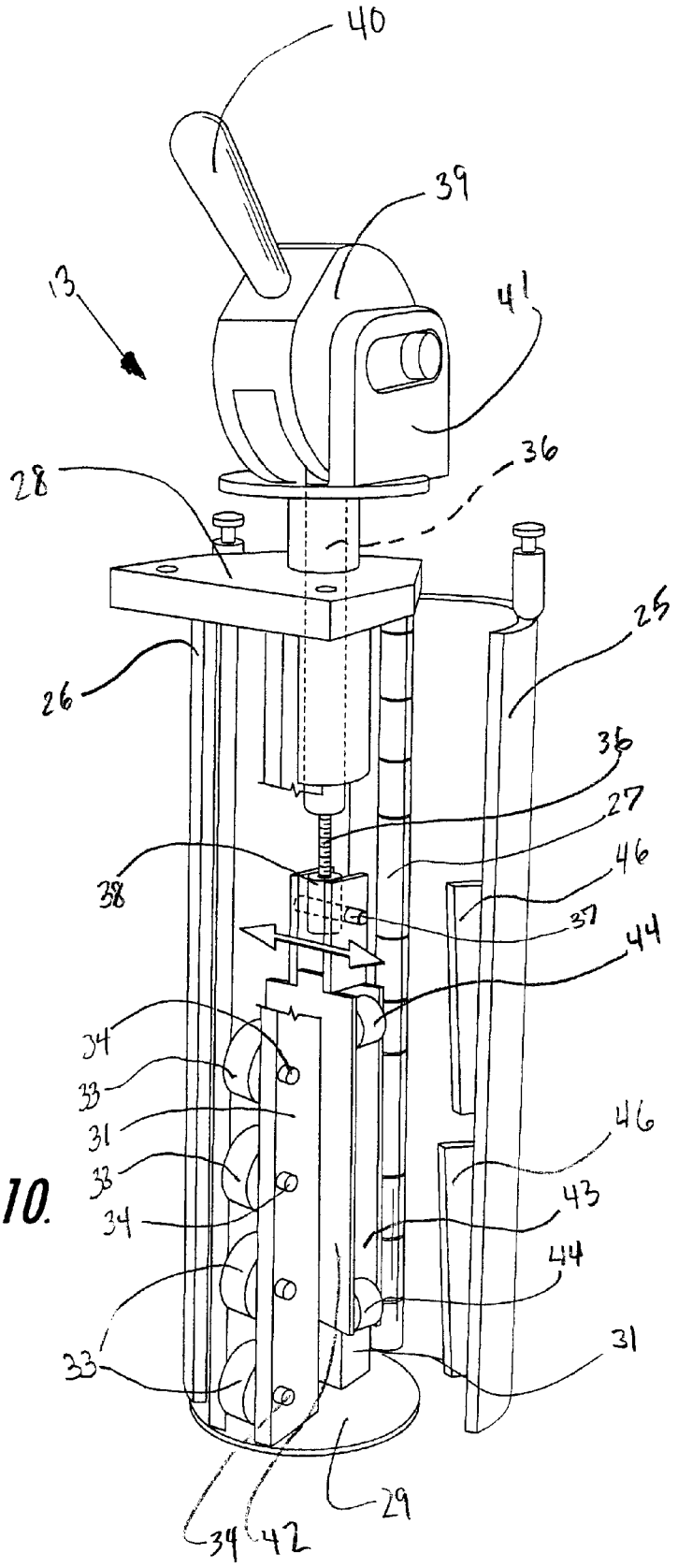
FIG. 10 is another perspective view of the support mandrel and expansion assembly shown in FIG. 9.

As shown in FIGS. 9 and 10, the expansion assembly 30 comprises a center divider 31 contained within the support mandrel 13 and extending longitudinally therethrough from the first lateral end plate 28 of support mandrel 13 to the second lateral end plate 29. The base of center divider 31 is attached to the pivot rod 27, enabling pivotal movement of the center divider 31. The top of the center divider 31 defines a chamber 32 in which a plurality of rollers 33 are positioned for facilitating insertion of the support mandrel 13 into a roll core 12 and removal therefrom. Preferably, there are six rollers 33, each having a surface width of approximately seven millimeters and a diameter of approximately two centimeters. The rollers 33 are positioned in the center divider 31 so that they protrude slightly, approximately three millimeters, above the center divider 31. Each roller 33 is connected to the center divider 31 by a screw 34 that extends through apertures in the center divider 31 and the roller 33. When the support mandrel 13 is inserted into roll core 12, the rollers 33 contact the interior of the roll 11 and facilitate insertion by rolling against the interior surface of roll 11, thereby reducing resistance caused by friction between the support mandrel 13 and the roll 11. The rollers 33 likewise facilitate removal of the roll 11 off of the support mandrel 13. When the support mandrel 13 is in the horizontal position and in the first smaller lateral dimension, the roll 11 rests on the rollers 33. As such, the roll 11 can easily slide off of the support mandrel 13 and onto a receiving apparatus.

The expansion assembly 30 includes a roller bracket 35 and a shaft 36 positioned between the top and the base of the center divider 31. The roller bracket 35 is connected to a transom 37 that extends laterally through the roller bracket 35 and a cylindrical receiving member 38. The transom 37 permits lateral movement of the roller bracket 35 back and forth along the length of the transom 37 within the support mandrel 13, as shown in FIG. 10.

Figure 4:
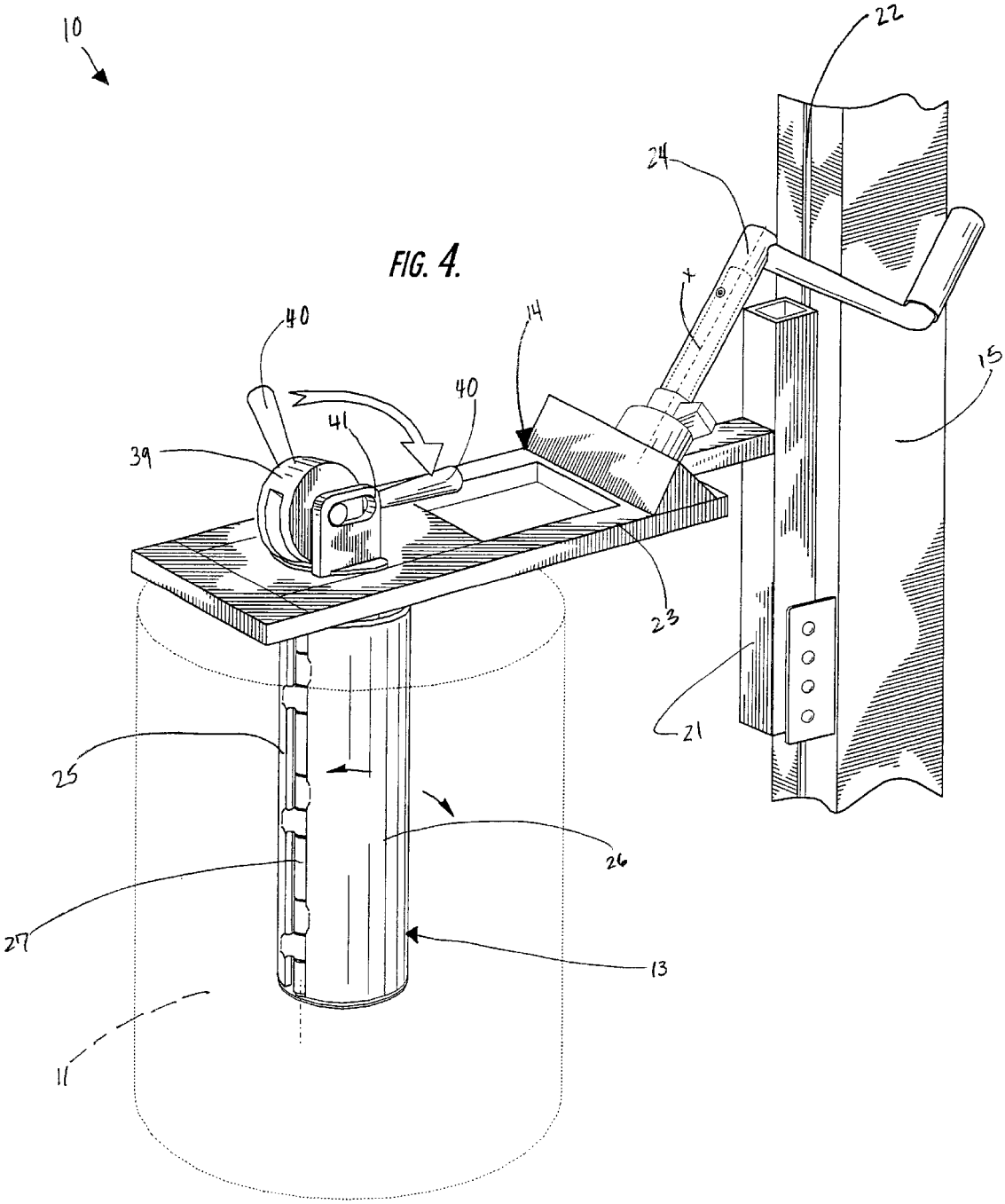
FIG. 4 shows the roll handling apparatus with the support mandrel expanded to engage the interior of the roll.

One end of the shaft 36 has male threading and is inserted into an aperture of the cylindrical receiving member 38. The interior of cylindrical receiving member 38 has female threading for engaging the male threading of shaft 36. The shaft 36 extends longitudinally within the support mandrel 13 from the receiving member 38 at one end and exits through an aperture defined by lateral end plate 28. The opposite end of the shaft connects to a cam 39 located outside of support mandrel 13. Attached to the cam 39 is a cam handle 40. The cam 39 communicates with a cam guide 41 so that when the handle 40 is pulled downward, as shown in FIG. 4, the shaft 36 is moved toward lateral end plate 28.

Figure 11:
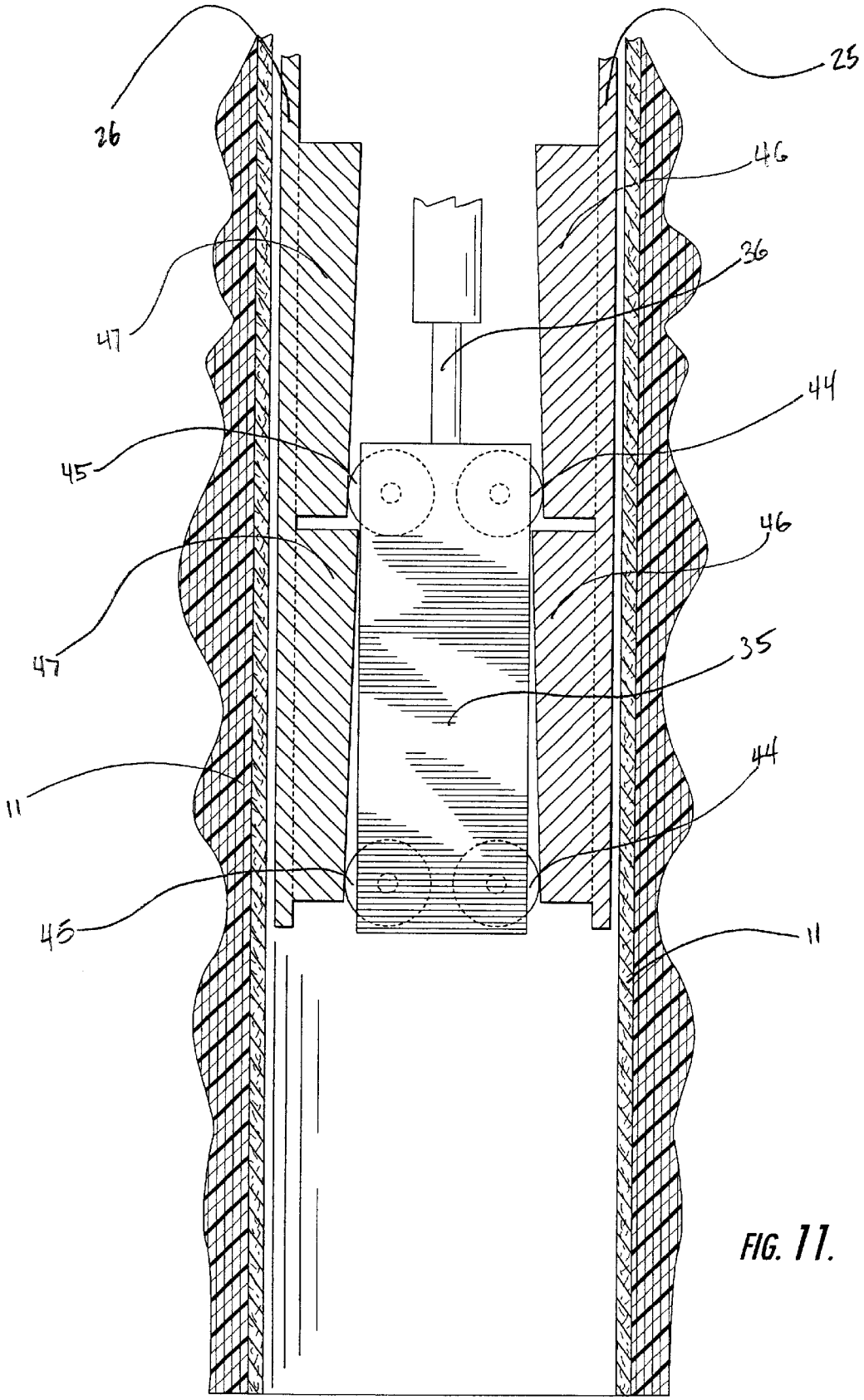
FIG. 11 is a partial cross sectional view of the support mandrel showing the expansion assembly contained therein.
Figure 12:
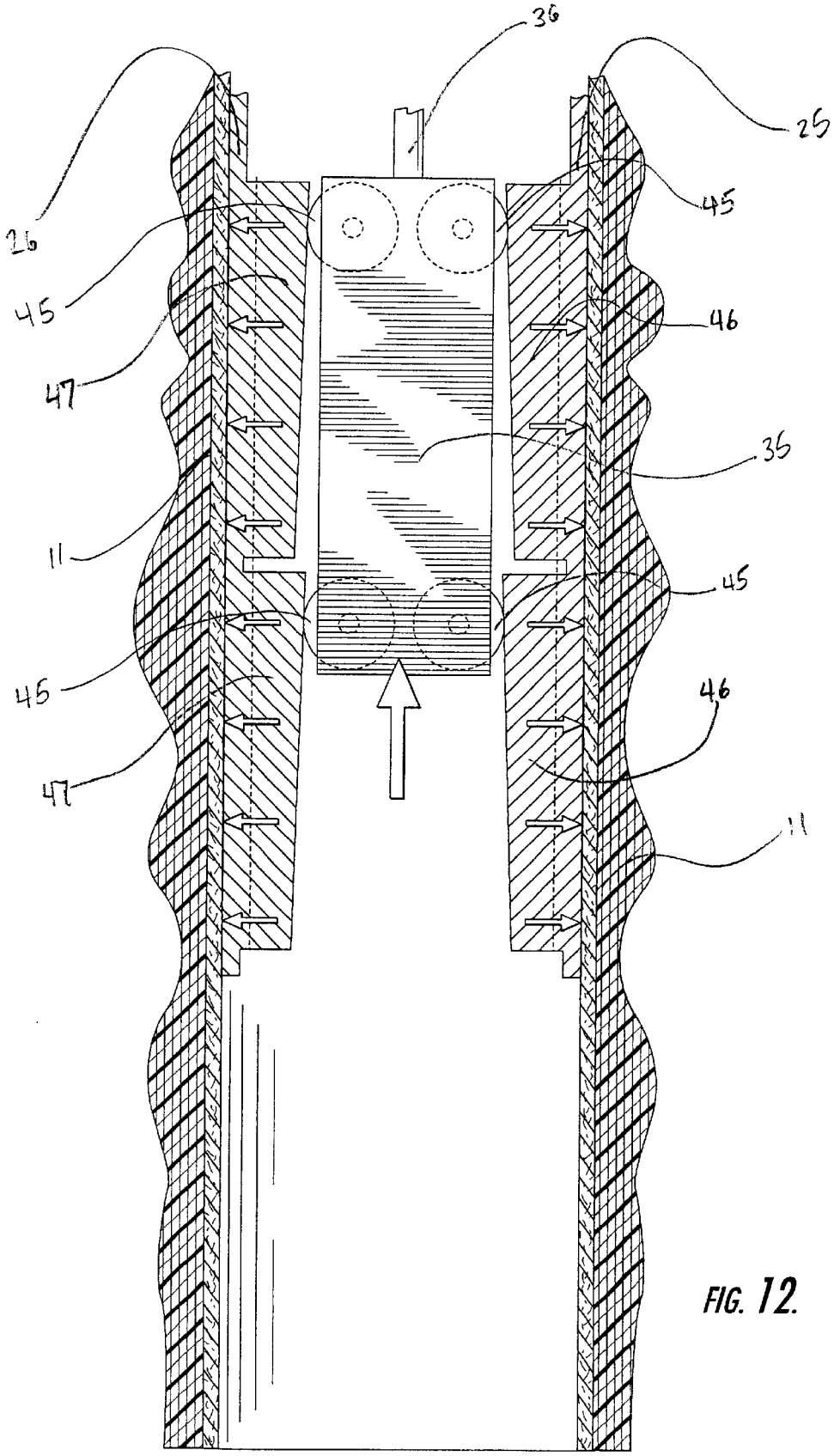
FIG. 12 shows the support mandrel expanding relative to movement of the expansion assembly.

The roller bracket 35 comprises two parallel rectangular plates 42, 43 and a plurality of rollers 44, 45 positioned between the plates 42, 43, with one of the rollers 44, 45 positioned at each corner of the rectangular plates, as shown in FIGS. 11 and 12. The rollers 44, 45 are in axial alignment with guiding members 46, 47, respectively, located on the interior sides of the semi-cylindrical plates 25, 26, respectively. Although FIGS. 9 and 10 show only rollers 44 and guiding members 46 on semi-cylindrical plate 25, it should be noted that rollers 45 have an identical relationship with guiding member 47 on semi-cylindrical plate 26. The guiding members 46, 47 have an angle of inclination with respect to the rollers 44, 45 and slope gradually upward in the direction of lateral end plate 28.

Figure 8:
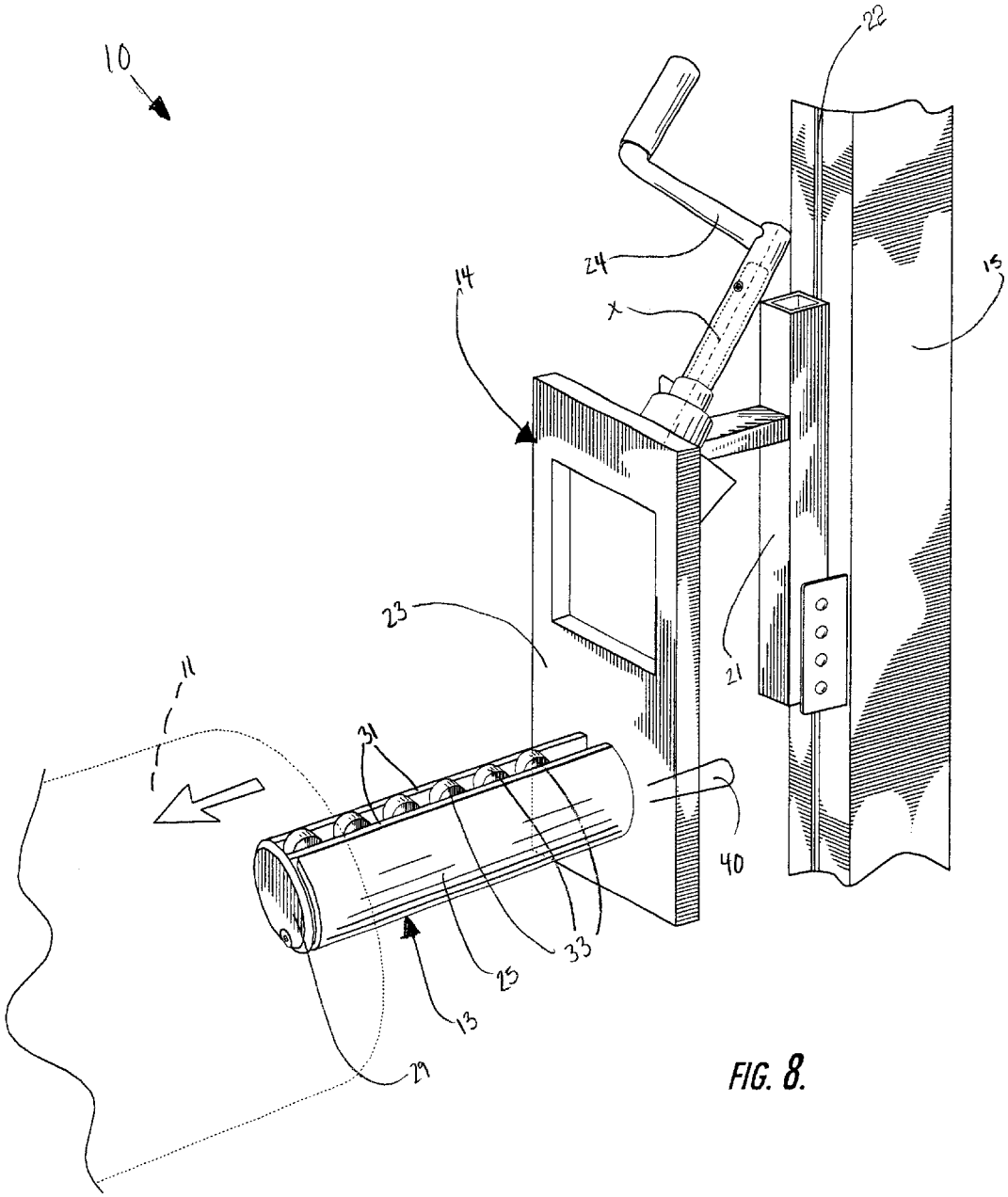
FIG. 8 shows the roll being moved off of the support mandrel.

When the support mandrel 13 is in its first, smaller dimension, shown in FIGS. 2, 3 and 8, rollers 44, 45 contact guiding members 46, 47, respectively, at the lowest point of the incline, as shown in FIG. 11. When handle 40 is pulled downward, as shown in FIG. 4, shaft 36 and roller bracket 35 are moved toward lateral end plate 28, thereby moving rollers 44, 45 up the incline of guiding members 46, 47, respectively, as shown in FIG. 12. As the rollers 44, 45 move against the increasing incline of the guiding members 46, 47, the semi-cylindrical plates 25, 26 are urged outward thereby expanding the lateral dimension of the support mandrel 13 until the semi-cylindrical plates 25, 26 frictionally engage the interior of the roll 11, as shown in FIGS. 4 and 12.

Figure 5:
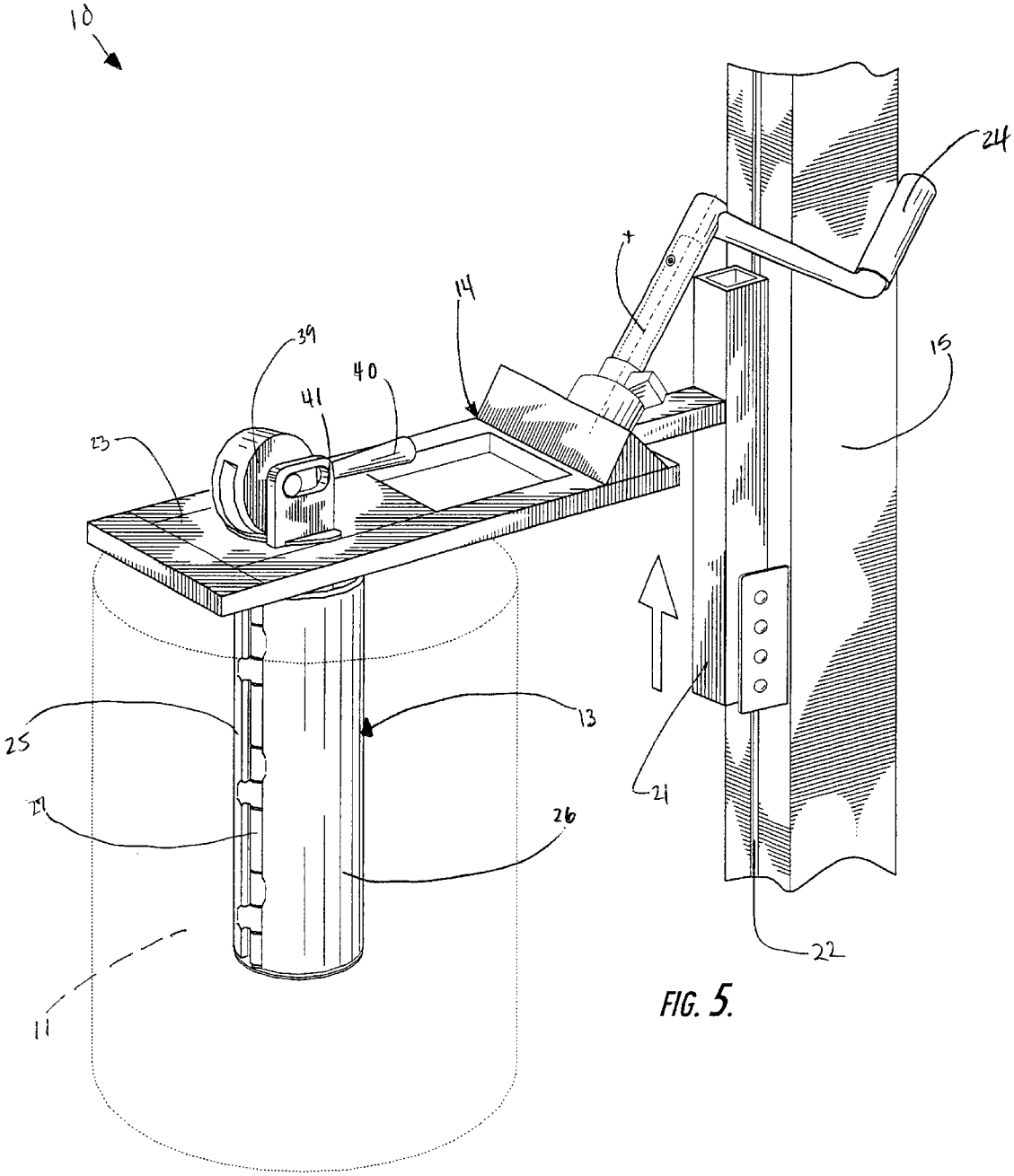
FIG. 5 shows the roll handling apparatus being raised vertically.

To move the roll 11 from a vertical position on a surface to a horizontal position at a desired height, the roll handling apparatus 10 is moved so that the roll 11 is positioned between the two forward legs 18, with the support mandrel 13 positioned directly over the roll core 12, as shown in FIGS. 1 and 2. The braking mechanism of the wheels 20 is set to keep the roll handling apparatus 10 in place. Next, the mounting bracket 21 is moved downward along the stanchion 15 to lower the support mandrel 13 into the roll core 12, as shown in FIGS. 2 and 3. Once inside the roll core 12, the cam handle 40 is pulled downward, as shown in FIG. 4, to move rollers 44, 45 along guiding members 46, 47, respectively, thereby urging the semi-cylindrical plates 25, 26 outward, as demonstrated in FIGS. 11 and 12, so that they frictionally engage the interior of roll 11. The plates 25, 26 are forced tightly against the interior of the roll 11 so that the roll 11 will move in unison with the support mandrel 13. The roll 11 can now be moved upward, as shown in FIG. 5, by moving the mounting bracket 21 upward along the stanchion 15. Once the roll 11 is raised to a desired height, the mounting bracket 21 is locked into place on the stanchion 15, and the roll 11 is rotated from its vertical position to a horizontal position by turning the swivel handle 24 in a clock-wise motion, as shown in FIG. 6. The braking mechanism, not shown, on the wheels 20 is released and the roll 11 can now be safely and easily transported to the desired location. Preferably, the roll 11 is transported while in the horizontal position only.

Figure 7:
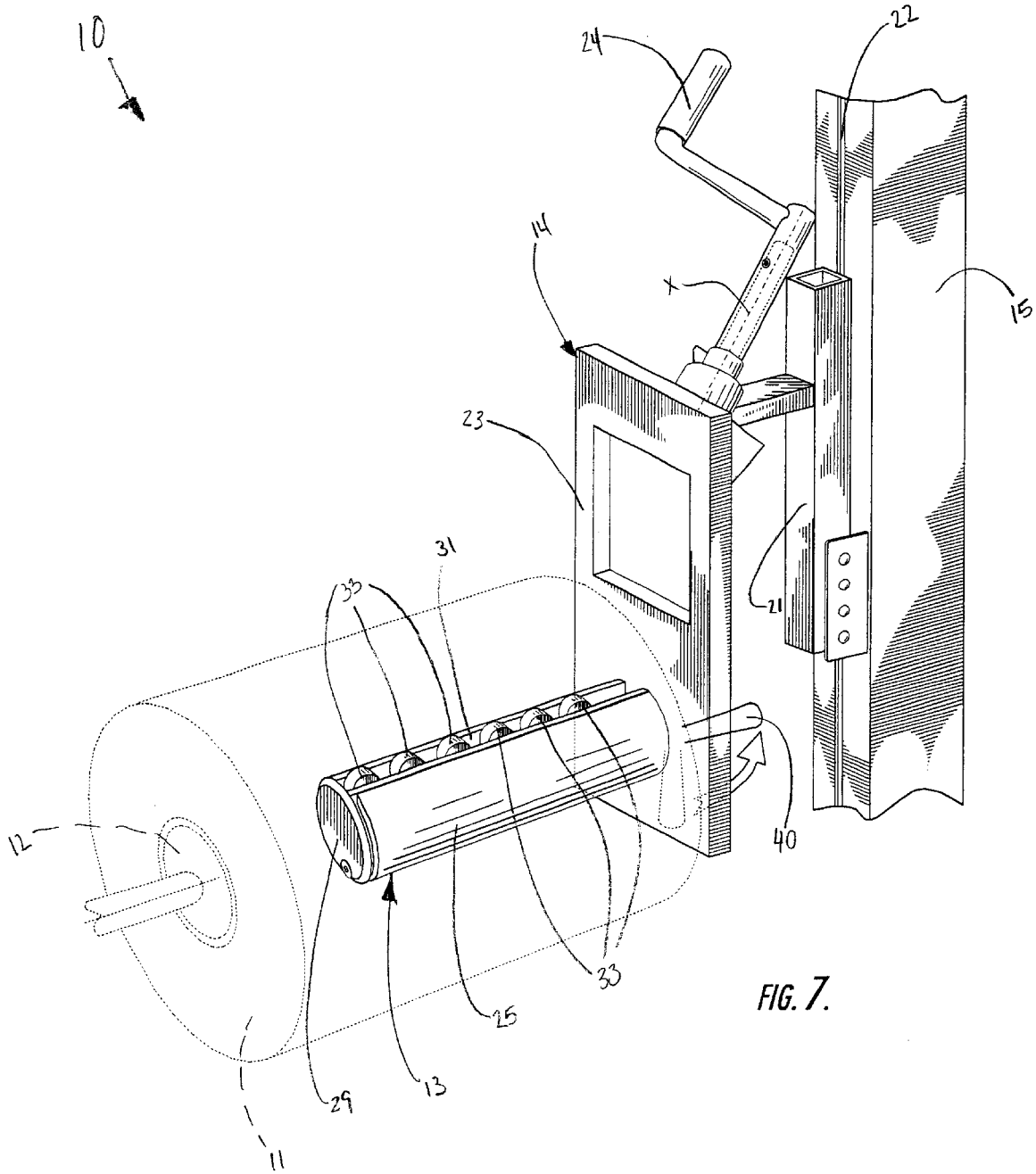
FIG. 7 shows the roll handling apparatus with the support mandrel in a horizontal position and released from frictional engagement with the roll.

The roll 11 can be easily moved off of the support mandrel 13 onto a receiving rod for storage. The roll handling apparatus 10 is moved along on a surface so that it is proximate to a receiving rod, not shown. Next, the height of the roll 11 is adjusted by moving the mounting bracket 21 along the stanchion 15 to the appropriate height so that the support mandrel 13 is axially aligned with the receiving rod. Once there is proper alignment, the braking mechanism is once again engaged. Next, the frictional engagement between the support mandrel 13 and the interior of the roll 11 is released by pulling the cam handle 40 upward, as shown in FIG. 7. Roll 11 now rests on the rollers 33, which allows the user to easily slide the roll 11 off of the support mandrel 13, as shown in FIG. 8, and onto a receiving rod for storage.

In another embodiment of the invention, an electric motor is provided that moves the mounting bracket 21 vertically on the stanchion 15, controls the expansion assembly 30, and rotates the support mandrel 13 about the swivel assembly 14 between vertical and horizontal positions. This electrically operated embodiment of the invention is preferably used for moving rolls of material up to three hundred pounds.

Figure 13:
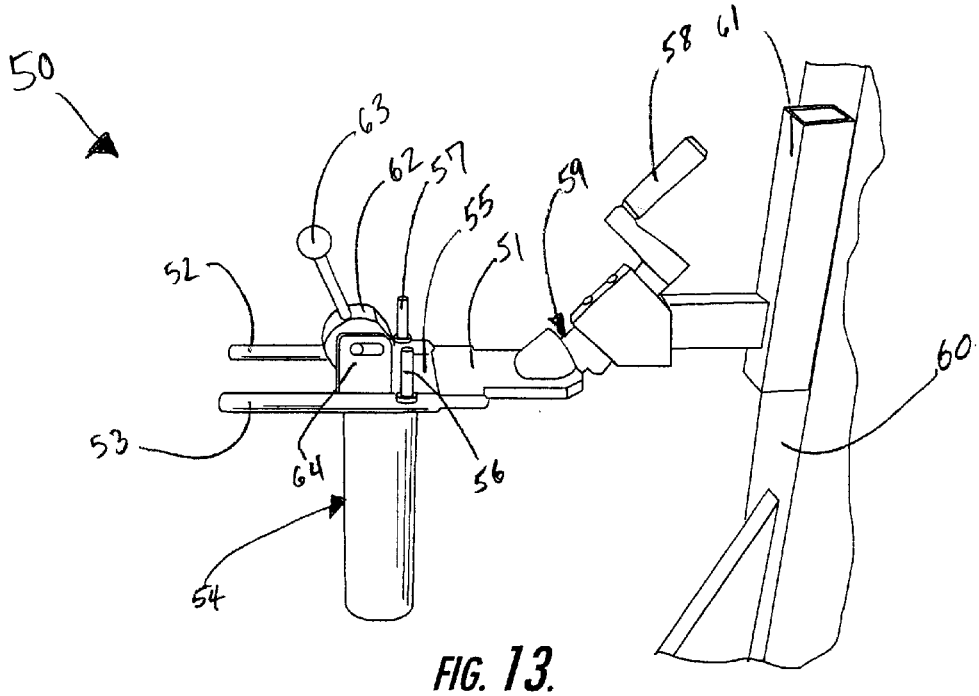
FIG. 13 is a perspective view of the roll handling apparatus according to another embodiment of the invention.
Figure 14:
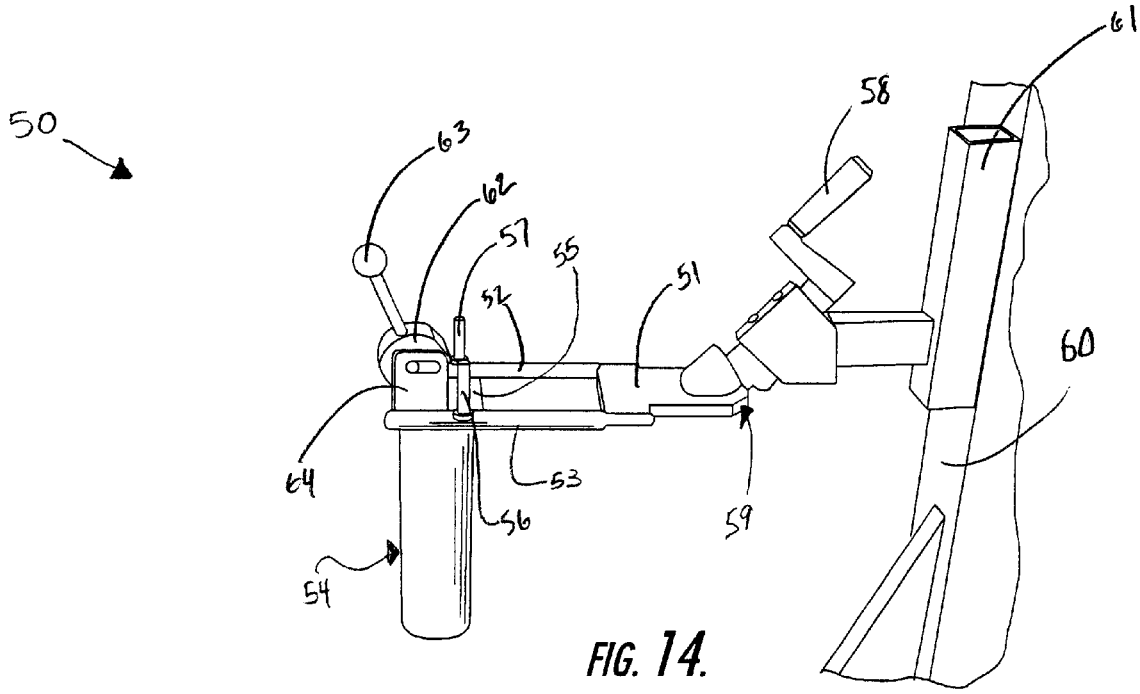
FIG. 14 is another perspective view of the roll handling apparatus shown in FIG. 13.

Yet another preferred embodiment of the invention is illustrated in FIGS. 13 and 14, and shown generally at reference numeral 50. The swivel plate 51 of roll handling apparatus 50 includes two parallel extending prongs 52 and 53. A support mandrel 54 includes a sliding unit 55 having two spring loaded locating pins 56 and 57. The sliding unit 55 of support mandrel 54 is positioned on the parallel prongs 52, 53 of the swivel plate 51. The locating pins 56, 57 are biased downward to engage the prongs 52, 53, respectively, thereby stabilizing the support mandrel 54 at a desired location on the swivel plate 51. Locating pins 56, 57 can be raised to release the engagement between the pins 56, 57 and the prongs 52, 53 to allow the sliding unit 55 to slide along the prongs 52, 53. This enables the support mandrel 54 to be positioned on various points on the prongs 52, 53 as demonstrated in FIGS. 13 and 14, to accommodate rolls of varying size. When the roll 11 to be moved is small, the support mandrel 54 is moved inward toward the swivel handle 58, as shown in FIG. 13, to properly align the swivel handle 58 with the roll 11, so that the roll handling apparatus 50 is balanced on all sides. When the roll 11 is relatively larger, the support mandrel 54 is moved along the prongs 52, 53 of swivel plate 51 away from the swivel handle 58 to obtain the proper alignment with roll 11, as shown in FIG. 14. In addition, support mandrel 54 can be completely removed from swivel plate 51 and replaced with another support mandrel of varying size. The roll handling apparatus 50 is similar to roll handling apparatus 10 in all other respects, including a stanchion 60, mounting bracket 61, cam 62, cam handle 63 and cam guide 64. In yet another embodiment, an electric motor can be provided for moving the support mandrel 54 along the prongs 52, 53.

An apparatus for moving an object having a bore therein and a method of using same is disclosed above. Various embodiments of the invention can be made without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An apparatus for moving an object having a bore therein defined by walls of the object from a first position to a second position, comprising:

(a) a support mandrel for being positioned in the bore at the first position in advance of moving the object, wherein said support mandrel comprises a hollow cylinder having an interior and exterior;

(b) en expansion assembly cooperating with said support mandrel for varying a lateral dimension of the support mandrel while positioned in the bore between a bore insertion dimension at which the support mandrel may be inserted into and withdrawn from the bore, and a bore engaging dimension at which the support mandrel engages the walls of the object defining the bore and locks the support mandrel and the object together against relative movement, said hollow cylinder comprising two semi-cylindrical plates connected to a pivot rod wherein said expansion assembly varies said lateral dimension of said support mandrel from said bore insertion dimension to said bore engaging dimension by urging said semi-cylindrical plates to pivotally move outward to frictionally engage said walls defining said bore; and (c) a swivel assembly to which the support mandrel is connected for movement from the first position to the second position whereby the object carried by the support mandrel is moved in unison with the movement of the support mandrel and is released by the support mandrel at the second position.

2. The apparatus of claim 1 wherein said first and second positions of said support mandrel define an angle of approximately ninety degrees.

3. The apparatus of claim 1 wherein said swivel assembly moves said support mandrel from a vertical position to a horizontal position.

4. The apparatus of claim 1 wherein said object comprises a roll of material having a cylindrical bore defined by inner walls of the roll.

5. The apparatus of claim 1 further including an electric motor in communication with said expansion assembly for varying the lateral dimension of said support mandrel between said insertion dimension and said engaging dimension.

6. The apparatus of claim 1 wherein said swivel assembly comprises a plate for mounting said support mandrel, and a handle connected to said plate and in communication with said support mandrel whereby turning said handle moves said support mandrel from said first position to said second position.

7. The apparatus of claim 6 wherein said support mandrel is releasably locked at a desired position on said plate and can be moved to varying positions on said plate to accommodate objects of varying size.

8. The apparatus of claim 6 wherein said support mandrel is positioned on said plate such that said object and said support mandrel counter-balance said swivel assembly to facilitate turning of said handle.

9. The apparatus of claim 1 further including a stanchion for mounting said swivel assembly, said swivel assembly vertically moveable along said stanchion for lowering said support mandrel into a bore defined by walls of an object on a surface and raising said object to a desired height above said surface.

10. The apparatus of claim 9 further including an electric motor in communication with said swivel assembly for moving said swivel assembly vertically along said stanchion.

11. The apparatus of claim 1 wherein said expansion assembly includes a center divider positioned within the interior of said support mandrel and extending longitudinally therethrough said center divider having a top and a base.

12. The apparatus of claim 11 wherein the base of said center divider is attached to said pivot rod.

13. An apparatus for moving an object having a bore therein defined by walls of the object from a first position to a second position, comprising:

a) a support mandrel for being positioned in the bore at the first position in advance of moving the object, wherein said support mandrel comprises a hollow cylinder having an interior and exterior;

b) an expansion assembly cooperating with said support mandrel for varying a lateral dimension of the support mandrel while positioned in the bore between a bore insertion dimension at which the support mandrel may be inserted into and withdrawn from the bore, and a bore engaging dimension at which the support mandrel engages the walls of the object defining the bore and locks the support mandrel and the object together against relative movement, wherein said expansion assembly includes a center divider positioned within the interior of said support mandrel and extending longitudinally therethrough, said center divider having a top and a base, and further wherein said expansion assembly includes a first roller longitudinally positioned in the top of said center divider for facilitating insertion of said support mandrel into said bore and withdrawal therefrom; and (c) a swivel assembly which the support mandrel is connected for movement from the first position to the second position whereby the object carried by the support mandrel is moved in unison with the movement of the support mandrel and is released by the support mandrel at the second position.

14. The apparatus of claim 13 further including a guiding member positioned longitudinally within the interior of said support mandrel and attached to one of said semi-cylindrical plates, said guiding member having an inclined surface.

15. The apparatus of claim 14 wherein said expansion assembly includes:

(a) a sliding member contained within said center divider for longitudinally moving within said support mandrel; and (b) a second roller attached to said sliding member, said second roller positioned within said support mandrel in axial alignment with said guiding member such that said second roller contacts said guiding member and urges said semi-cylindrical plate to pivotally move outward as said sliding member moves in a direction of increased inclination of said guiding member whereby said semi-cylindrical plate contacts and frictionally engages said walls defining said bore.

16. An apparatus for moving an object having a bore therein defined by walls of the object from a first position to a second position, comprising:

(a) a support mandrel for positioned in the bore at the first position in advance of moving the object;

(b) an expansion assembly cooperating with said support mandrel for varying a lateral dimension of the support mandrel while positioned in the bore between a bore insertion dimension at which the support mandrel may be inserted into and withdrawn from the bore, and a bore engaging dimension at which the support mandrel engages the walls of the object defining the bore and locks the support mandrel and the object together against relative movement, said expansion assembly comprising two semi-cylindrical plates connected to a pivot rod wherein said expansion assembly varies said lateral dimension of said support mandrel from said bore insertion dimension to said bore engaging dimension by urging said semi-cylindrical plates to pivotally move outward to frictionally engage said walls defining said bore, and wherein said expansion assembly further includes:

(i) a center divider positioned within the interior of said support mandrel and extending longitudinally therethrough, said center divider having a top and a base, (ii) a guiding member positioned longitudinally within the interior of said support mandrel and attached to one of said semi-cylindrical plates, said guiding member having an inclined surface, (iii) a sliding member contained within said center divider for longitudinally moving within said support mandrel, (iv) a roller attached to said sliding member, said roller positioned within said support mandrel in axial alignment with said guiding member such that said second roller contacts said guiding member and urges said semi-cylindrical plate to pivotally move outward as said sliding member moves in a direction of increased inclination of said guiding member whereby said semi-cylindrical plate contacts and frictionally engages said wall defining said bore, and (v) a cam mounted to the exterior of said support mandrel and connected to said sliding member whereby said sliding member is responsive to movement of said cam; and (c) a swivel assembly to which the support mandrel is connected for movement from the first position to the second position whereby the object carried by the support mandrel is moved in unison with the movement of the support mandrel and is released by the support mandrel at the second position.

17. A method for moving an object having a bore therein defined by walls of the object from a vertical position on a surface to a horizontal position at a predetermined height comprising the steps of:

(a) providing an apparatus comprising:

(i) a support mandrel comprising two semi-cylindrical plates connected to a pivot rod, and guiding members positioned longitudinally within the Interior of said support mandrel and attached to said semi-cylindrical plates, said guiding members having an inclined surface, (ii) an expansion assembly comprising a center divider having a top and a base positioned within said support mandrel and extending longitudinally therethrough, a first plurality of rollers longitudinally positioned in the top of said central member, said first plurality of rollers for facilitating insertion of said support mandrel into said bore defined by said object and removal therefrom, a sliding member contained within said center divider, and a second plurality of rollers attached to said sliding member, said second plurality of rollers positioned in axial alignment with said guiding members such that said second plurality of rollers contacts said guiding members and urges said semi-cylindrical plates to pivotally move outward when said sliding member is moved in a direction of increasing inclination of said guiding members, (iii) a swivel assembly for mounting said support mandrel and moving said support mandrel about an angle of rotation of approximately ninety degrees, and (iv) a stanchion for mounting said swivel assembly, said swivel assembly vertically moveable along said stanchion;

(b) inserting said support mandrel into said bore defined by said object positioned vertically on a surface;

(c) engaging said object with said support mandrel by moving said sliding member in the direction of increasing inclination of said guiding members to urge said semi-cylindrical plates to pivotally move outward and frictionally engage said walls of said object;

(d) lifting said object off of said surface up to a predetermined height by moving said swivel assembly upward along said stanchion; and (e) moving said object from a vertical position to a horizontal position by moving said swivel plate to rotate said support mandrel about said angle of rotation.

18. The method of claim 17 further including the step of axially aligning said support mandrel with a receiving rod.

19. The method of claim 18 further including the step of disengaging said support mandrel from said object by moving said sliding member in a direction of declination of said guiding member so that said semi-cylindrical plates pivotally move inward and away from said walls of said object so that said object rests on said first roller.

20. The method of claim 19 further including the step of sliding said object on said first roller oil of said support mandrel onto said receiving rod.

* * * * *

UNITED STATES PATENT AND TRADEMARK OFFICE

CERTIFICATE OF CORRECTION

PATENT NO. : 6,648,580 B2
DATED : November 18, 2003
INVENTOR(S) : Lofgren

It is certified that error appears in the above-identified patent and that said Letters Patent is hereby corrected as shown below:

Column 8,
Line 52, please delete “en” and insert -- an --

Column 9,
Line 48, please insert -- , --after “therethrough”

Column 10,
Line 36, please insert -- being -- after “a support mandrel for”

Column 11,
Line 7, please delete “wall” and insert -- walls --
Line 25, please delete “Interior” and insert -- interior --

Column 12,
Line 36, after “first roller”, please delete “oil” and insert -- off --.

Signed and Sealed this

Twenty-second Day of June, 2004

JON W. DUDAS
*Acting Director of the United States Patent and Trademark Office*